US010418009B2

(12) United States Patent
Juszkiewicz

(10) Patent No.: US 10,418,009 B2
(45) **Date of Patent: *Sep. 17, 2019**

(54) ACOUSTIC GUITAR USER INTERFACE

(71) Applicant: GIBSON BRANDS, INC., Nashville, TN (US)

(72) Inventor: Henry Juszkiewicz, Nashville, TN (US)

(73) Assignee: Gibson Brands, Inc., Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/173,328

(22) Filed: Oct. 29, 2018

(65) Prior Publication Data

US 2019/0066642 A1 Feb. 28, 2019

Related U.S. Application Data

(63) Continuation of application No. 15/498,718, filed on Apr. 27, 2017, now Pat. No. 10,115,379.

(51) Int. Cl.

| | |
|---|---|
| ***G10H 1/00*** | (2006.01) |
| ***G10H 1/02*** | (2006.01) |
| ***G10H 1/46*** | (2006.01) |
| ***G10H 3/14*** | (2006.01) |
| ***G10H 3/18*** | (2006.01) |

(52) U.S. Cl.

CPC ..... *G10H 1/0008* (2013.01); *G10H 1/0091* (2013.01); *G10H 1/02* (2013.01); *G10H 1/46* (2013.01); *G10H 3/143* (2013.01); *G10H 3/186* (2013.01); *G10H 2210/235* (2013.01); *G10H 2210/251* (2013.01); *G10H 2210/265* (2013.01); *G10H 2210/281* (2013.01); *G10H 2220/116* (2013.01); *G10H 2230/035* (2013.01); *G10H 2240/211* (2013.01); *G10H 2250/105* (2013.01)

(58) Field of Classification Search

CPC ..... G10H 1/0008; G10H 1/02; G10H 1/46; G10H 3/186; G10H 2210/251; G10H 2210/265; G10H 2220/116; G10H 2230/035; G10H 2240/211; G10H 2250/105

USPC ..... 84/626

See application file for complete search history.

(56) References Cited

U.S. PATENT DOCUMENTS 5,025,703 A * 6/1991 Iba ..... G10H 1/0091 84/678
5,576,507 A * 11/1996 LaMarra ..... G10H 1/0066 84/645
5,834,671 A * 11/1998 Phoenix ..... G10H 1/0066 84/645

(Continued)

*Primary Examiner* — David S Warren
*Assistant Examiner* — Christina M Schreiber

(57) ABSTRACT

An acoustic guitar is provided that includes a neck and a body. The acoustic guitar also includes a user interface module including an audio effect module configured to implement one or more audio effects, and one or more effect controllers, with each effect controller being configured to set a level of a corresponding audio effect implemented by the audio effect module. The user interface module further includes at least one input blend controller and a voice controller configured to allow a user to select a patch from a plurality of available patches, with each patch of the plurality of available patches comprising a configuration of one or more audio effects set at various levels to arrive at a desired effect template.

19 Claims, 9 Drawing Sheets

(56) References Cited

U.S. PATENT DOCUMENTS 5,866,834 A * 2/1999 Burke ..... G10H 1/46 84/622
6,448,488 B1 * 9/2002 Ekhaus ..... G10H 1/125 84/622
6,696,632 B2 * 2/2004 Minakuchi ..... G10H 1/32 84/290
6,787,690 B1 * 9/2004 Celi ..... G10H 1/125 84/600
7,241,948 B2 * 7/2007 Cummings ..... G10H 3/188 84/723
7,355,110 B2 * 4/2008 Nash ..... G10H 1/32 84/267
7,518,055 B2 * 4/2009 Zartarian ..... H04H 60/04 84/615
7,812,243 B2 * 10/2010 Celi ..... G10H 1/053 84/723
7,935,876 B1 * 5/2011 West ..... G10D 3/146 84/200
8,148,624 B2 * 4/2012 Raisanen ..... G10H 1/055 84/615
8,542,848 B1 * 9/2013 Krutsick ..... G10H 3/187 330/127
8,658,879 B2 * 2/2014 Gillette ..... G10H 3/185 84/723
9,000,287 B1 * 4/2015 Andersen ..... G10H 1/32 84/622
9,093,057 B2 * 7/2015 Mejia ..... G10H 1/02
9,099,069 B2 * 8/2015 Shinoda ..... G10H 1/125
9,286,874 B1 * 3/2016 Micek ..... G10H 3/18
9,633,640 B1 * 4/2017 Lee ..... G10H 1/348
9,640,162 B2 * 5/2017 Ball ..... G10H 1/18
10,115,379 B1 * 10/2018 Juszkiewicz ..... G10H 1/0008
2001/0015124 A1 * 8/2001 Marinic ..... G10H 1/10 84/644
2004/0003703 A1 * 1/2004 Chapman ..... G10D 1/085 84/453
2004/0187673 A1 * 9/2004 Stevenson ..... G10H 1/02 84/737
2005/0039594 A1 * 2/2005 Dubal ..... G10H 3/187 84/737
2005/0045027 A1 * 3/2005 Celi ..... G10H 1/053 84/723
2006/0000347 A1 * 1/2006 Preece ..... G10H 1/36 84/741
2006/0196348 A1 * 9/2006 Cummings ..... G10H 3/188 84/731
2007/0000375 A1 * 1/2007 Harrison, Jr. ..... G04B 25/00 84/737
2007/0003073 A1 * 1/2007 Iriarte ..... G10H 1/0083 381/77
2007/0227344 A1 * 10/2007 Ryle ..... G10H 1/053 84/723
2007/0234880 A1 * 10/2007 Adams ..... G10H 1/0066 84/601
2008/0156180 A1 * 7/2008 Bagale ..... G10H 1/40 84/743
2011/0218022 A1 * 9/2011 Chiu ..... G06F 17/00 463/7
2011/0226119 A1 * 9/2011 Shinoda ..... G10H 1/125 84/736
2014/0150630 A1 * 6/2014 Juszkiewicz ..... G10H 1/44 84/626
2014/0202316 A1 * 7/2014 Szalay ..... G10H 1/0066 84/645
2014/0260922 A1 * 9/2014 Jennings ..... G10H 3/143 84/731
2014/0270215 A1 * 9/2014 Lin ..... G10H 1/0091 381/61
2015/0013526 A1 * 1/2015 Packouz ..... G10H 3/186 84/603
2015/0059561 A1 * 3/2015 Mejia ..... G10H 1/02 84/737
2016/0335997 A1 * 11/2016 White ..... G10H 3/186
2017/0076705 A1 * 3/2017 Iori ..... G10H 3/12
2017/0178610 A1 * 6/2017 Langberg ..... G10D 3/00

* cited by examiner

ACOUSTIC GUITAR USER INTERFACE

CROSS-REFERENCE TO RELATED APPLICATION

This application is a continuation of U.S. patent application Ser. No. 15/498,718 filed Apr. 27, 2017, titled: Acoustic Guitar User Interface, which is hereby incorporated by reference in its entirety.

BACKGROUND

Many guitarists prefer the feel and sound of an acoustic guitar to that of an electric guitar. This can include performing artists who might wish to have their acoustic guitars amplified and broadcast to a listening audience, as well as recording artists who might wish to have their acoustic guitars recorded.

SUMMARY

In an example embodiment, an acoustic guitar is provided that includes a neck and a body. The acoustic guitar also includes a user interface module including an audio effect module configured to implement one or more audio effects, and one or more effect controllers, with each effect controller being configured to set a level of a corresponding audio effect implemented by the audio effect module. The user interface module further includes at least one input blend controller and a voice controller configured to allow a user to select a patch from a plurality of available patches, with each patch of the plurality of available patches comprising a configuration of one or more audio effects set at various levels to arrive at a desired effect template.

In another example embodiment, user interface module for an acoustic guitar is provided with a volume controller and one or more effect controllers, with each effect controller being configured to set a level of a corresponding audio effect. The user interface module also includes a voice controller configured to allow a user to select a patch from a plurality of available patches, with each patch comprising a combination of one or more audio effects set at various levels to arrive at a desired effect template.

In yet another example embodiment, an acoustic guitar is provided with a neck, a hollow body, and a user interface module. The user interface module has functionality associated with one or more audio effects, one or more effect controllers and at least one input blend controller. The user interface module also has a voice controller configured to allow a user to select from among a plurality of various patches, with each patch representing an individual effect template. The user interface module further includes an antenna module configured to facilitate communication between the user interface module and an external device.

This summary is not intended to identify key or essential features of the claimed subject matter, nor is it intended to be used as an aid in limiting the scope of the claimed subject matter.

Other features of the current disclosure will become apparent to those skilled in the art upon review of the following drawings, the detailed description, and the appended claims.

BRIEF DESCRIPTION OF THE DRAWINGS

Illustrative embodiments will be described referring to the accompanying drawings, wherein like numerals denote like elements.

DETAILED DESCRIPTION

In the following description, numerous details are set forth to provide an understanding of some embodiments of the present disclosure. However, it will be understood by those of ordinary skill in the art that the systems and/or methodologies may be practiced without these details and that numerous variations or modifications from the described embodiments may be possible.

As described herein, various techniques and technologies associated with allowing a user to manipulate the sound being output from an acoustic guitar are presented. In one possible implementation, a user interface module mounted on the acoustic guitar can allow the user to manipulate how sounds from the guitar are sensed (such as, for example, by various pickups, a microphone, or a blend thereof) and/or how sensed sounds from the guitar are manipulated via various audio effect technologies, such as reverb, chorus, tone, delay, various filters, etc. In one possible aspect, preset combinations of the various audio effect technologies can be saved as individual patches. In another possible aspect, some patches can be used to make the output from the acoustic guitar sound as though it came from another instruments, such as a mandolin, a banjo, etc.

Example User Interface Module

Figure 1:
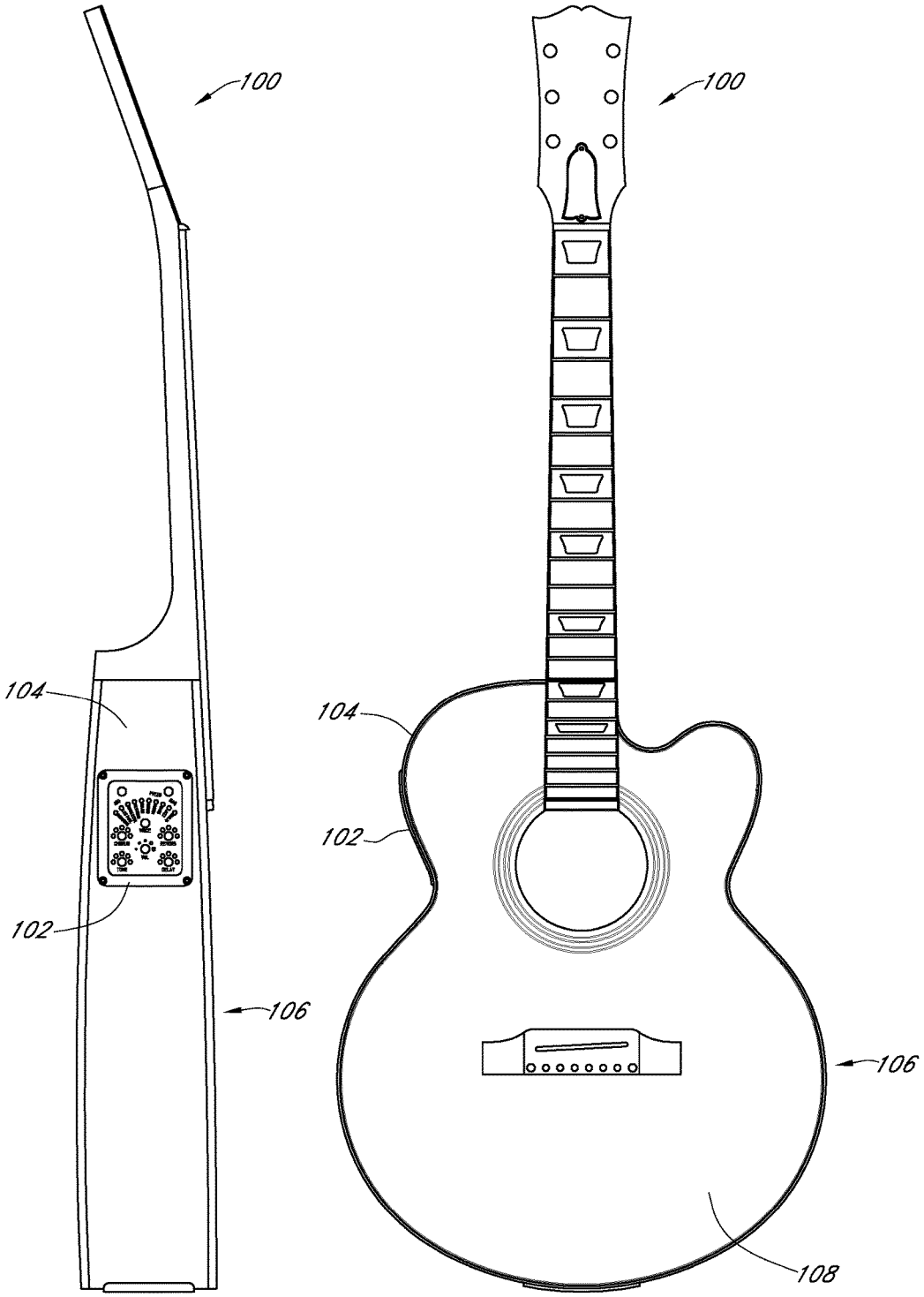
FIG. 1 illustrates an example acoustic guitar including an example user interface module in accordance with various implementations of acoustic guitar user interface.

FIG. 1 illustrates an example acoustic guitar 100 including an example user interface module 102 in accordance with various implementations of acoustic guitar user interface. In one possible implementation, user interface module 102 can be used by a user (such as, for example, a musician playing acoustic guitar 100) to manipulate an audio signal output from acoustic guitar 100. Acoustic guitar 100 can include any acoustic guitar known in the art such as, for example, acoustic guitars marketed by Gibson Brands, Incorporated of Nashville, Tenn.

In one possible implementation, user interface module 102 can be located on a shoulder 104 of a body 106 of acoustic guitar 100. In other possible implementations, user interface module 102 can be placed at any other location on acoustic guitar 100.

Moreover, in addition to comprising a single unit, in some possible embodiments, user interface module 102 can exist in several parts. For example, one portion of user interface module 102 can be included on shoulder 104, while other portion(s) of user interface module 102 can be included on a face 108 of acoustic guitar 100, on other parts of acoustic guitar 100, and/or on an external device (such as a mixing board, a smartphone, a tablet, a laptop, etc.). In such a manner, all or portions of user interface module 102 can be placed in any possible location, and/or combination of locations, that might be desirable to a user of acoustic guitar 100. Face 108 can have any finish known in the art, including, for example, an anodized aluminum finish.

A variety of other equipment can also be placed on and/or in guitar 100. For example, in one possible implementation, one or more batteries can be housed in a battery compartment outside and/or inside of acoustic guitar 100. In one possible embodiment, the battery compartment can be located close to an audio output connector from guitar 100 and/or user interface module 102.

Any types of batteries known in the art can be used to power user interface module 102, including, for example, rechargeable batteries, batteries of the 18650 type, etc. Moreover, batteries having any capacity known in the art can be used, including, for example, batteries having a capacity of 2500 mAh.

In one possible implementation, a battery charger can be present. In instances where two or more of the batteries present, such a battery charger can be used for simultaneous and balanced charging of the two or more batteries present.

Battery chargers can include any battery charging technologies known in the art, including any wireless battery charging technologies known in the art. Further, one or more battery chargers can be located anywhere known in the art including on, in, and/or proximate to acoustic guitar 100. For example, one or more battery chargers (including wired and/or wireless battery chargers) can be located in a guitar case associated with acoustic guitar 100, on a stand associated with guitar 100, etc. In one possible aspect, the battery charger can be connected to a power source via any connection technology known in the art, including, for example, a USB connection. In another possible aspect, one or more additional power batteries can be present (such as in a guitar case, for example) and can charge acoustic guitar 100 when other power sources are unavailable.

Functionality can also be present to protect against various events, including, for example, overcurrent, overcharging, under-voltage lockout, etc. Moreover, in one possible aspect, in addition to powering user interface module 102, the one or more batteries in the battery compartment can also be used to power other electronic functionality on guitar 100, such as for example, auto-tuning functionality, etc. In other possible aspects, other batteries/power sources on acoustic guitar 100 can be used to power other electronic functionality on guitar 100 outside of user interface module 102.

In one possible implementation, a jack allowing a signal associated with guitar 100 to be transmitted from acoustic guitar 100 can be located anywhere on guitar 100. The jack can be any jack known in the art, including, for example, an XLR/TRS stereo jack.

In one possible embodiment, user interface module 102 can include functionality (including one or more antennas, an antenna module, etc.) for wireless connectivity using any wireless conventions and/or technology known in the art, allowing user interface module 102 to wirelessly communicate commands and/or data (including, for example, audio signals, audio tracks, etc.) between user interface module 102 and a variety of external devices, such as a mixing board, an effect rack, a smartphone, a tablet, a laptop, etc.

Sounds created by acoustic guitar 100 can be detected using any possible sound detection equipment known in the art including, for example, one or more microphones (including electret-condenser microphones and/or other microphones configured to detect resonant sound in body 106 of acoustic guitar 100 which can be adjustable over a wide range in the resonant chamber of acoustic guitar 100) and/or one or more pickups, including, for example, piezo pickups (such as, for instance a hexaphonic piezo pickup with an integrated amplifier and connector), magnetic pickups, etc. Sound detection equipment can be placed anywhere known in the art including on, in, and/or proximate to acoustic guitar 100.

Figure 2:
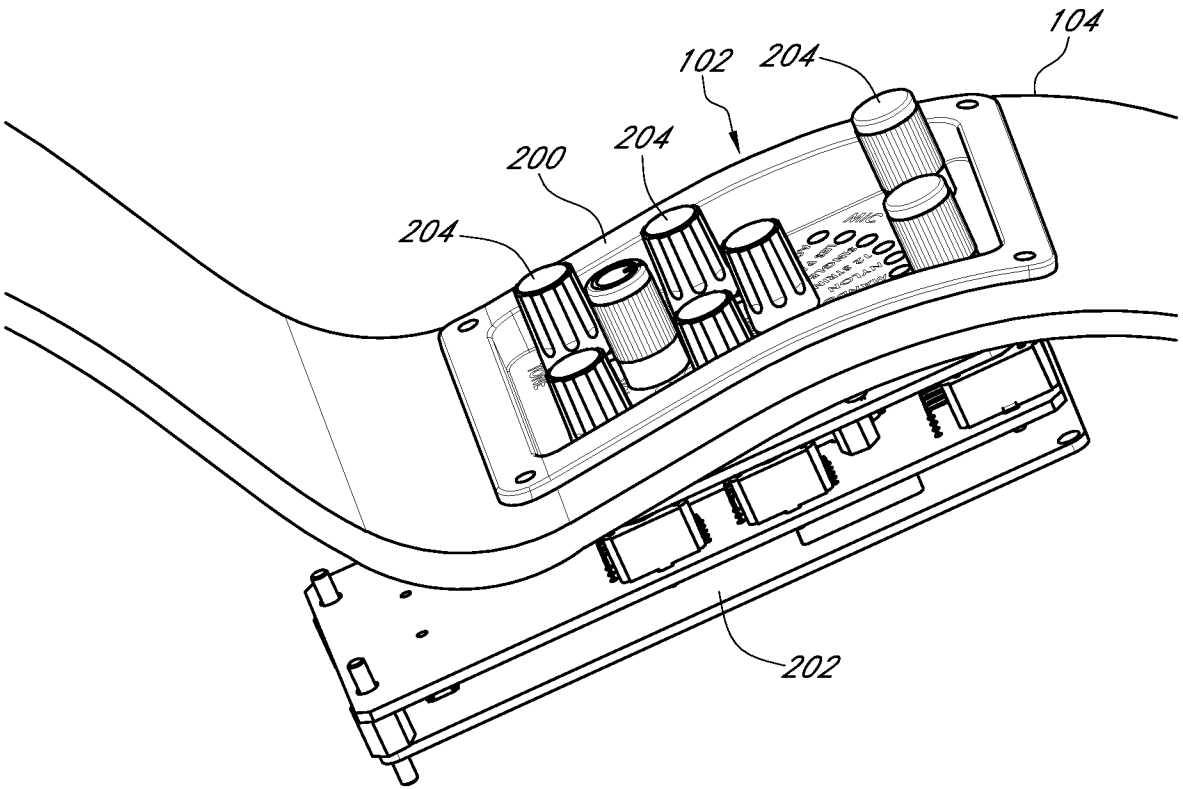
FIG. 2 illustrates an example user interface module including a face and an audio effect module in accordance with various implementations of acoustic guitar user interface.

FIG. 2 illustrates an example user interface module 102 including a face 200 and an audio effect module 202 in accordance with various implementations of acoustic guitar user interface. In one possible implementation, face 200 can include one or more user interaction devices 204 configured to allow a user to interact with functionality in user interface module 102, including, for example, functionality (such as effects, filters, mixers, etc.) in audio effect module 202. Interaction devices 204 on face 200 can include any interaction devices/controllers known in the art, including, for example, one or more buttons, dials, sliders, knobs, rotary encoders (including endless encoders and/or encoders with any other range of rotation known in the art), potentiometers (including 270 degree potentiometers), light emitting diodes (LEDs) (including flat, low current, energy saving LEDs), displays (including touch screen displays), etc., and any combination thereof. For example, in some possible implementations, all or part of face 200 can include a touchscreen (including, for example, a flat touchscreen, a curved touchscreen, etc.), which itself can include any types of interaction devices/controllers (including various displays, and functionality registering any interaction mechanisms known in the art, such as finger swipes, swipe combinations, etc.) implementable on a touchscreen and configurable to allow a user to interact with functionality in user interface module 102.

Audio effect module 202 can include any functionality configured to create and/or manipulate an audio signal associated with acoustic guitar 100. For example, in one possible implementation, audio effect module 202 can include functionality to create any audio effects known in the art, including, for example, audio effects such as delay, reverb, chorus, tone, distortion, string effects (including multiple string effects), various instrument voice effects (which, for example, make the output of acoustic guitar 100 sound as though it came from another instrument), etc. Functionality in audio effect module 202 can be implemented in any manner known in the art including, for example, analog electronic circuitry, digital electronic circuitry (including one or more computing devices, software, firmware, etc.), and any combination thereof.

As mentioned above in conjunction with FIG. 1, in some possible implementations, user interface module 102 can exist in several parts and/or at several locations. Thus, in some possible implementations, parts of face 200 can exist at various locations on acoustic guitar 100 and/or on devices external to acoustic guitar 100, such as computing devices including mixing boards, smartphones, effect racks, tablets, computers, etc.

Moreover, in addition to being co-located with face 200 as shown in FIG. 2, all or portions of audio effect module 202 can be located remote from user interface module 102, including at one or more locations on acoustic guitar 100 and/or one or more locations remote from acoustic guitar 100, such as on one or more computing devices including smartphones, effects racks, tablets, laptops, etc.

For example, in one possible implementation, audio effect module 202 can be located on another portion of guitar 100 away from face 200. Alternately, or additionally, all or part of audio effect module 202 can be located on a remote device, such as an effect rack, a mixing board, a smartphone, a tablet, a laptop, etc., in communication with user interface module 102. In still another possible implementation, a portion of audio effect module 202 can be co-located with face 200, and one or more other portions of audio effect module 202 can be located remote from face 200, such as, for example, on other portions of guitar 100 and/or remote from guitar 100.

Figure 3:
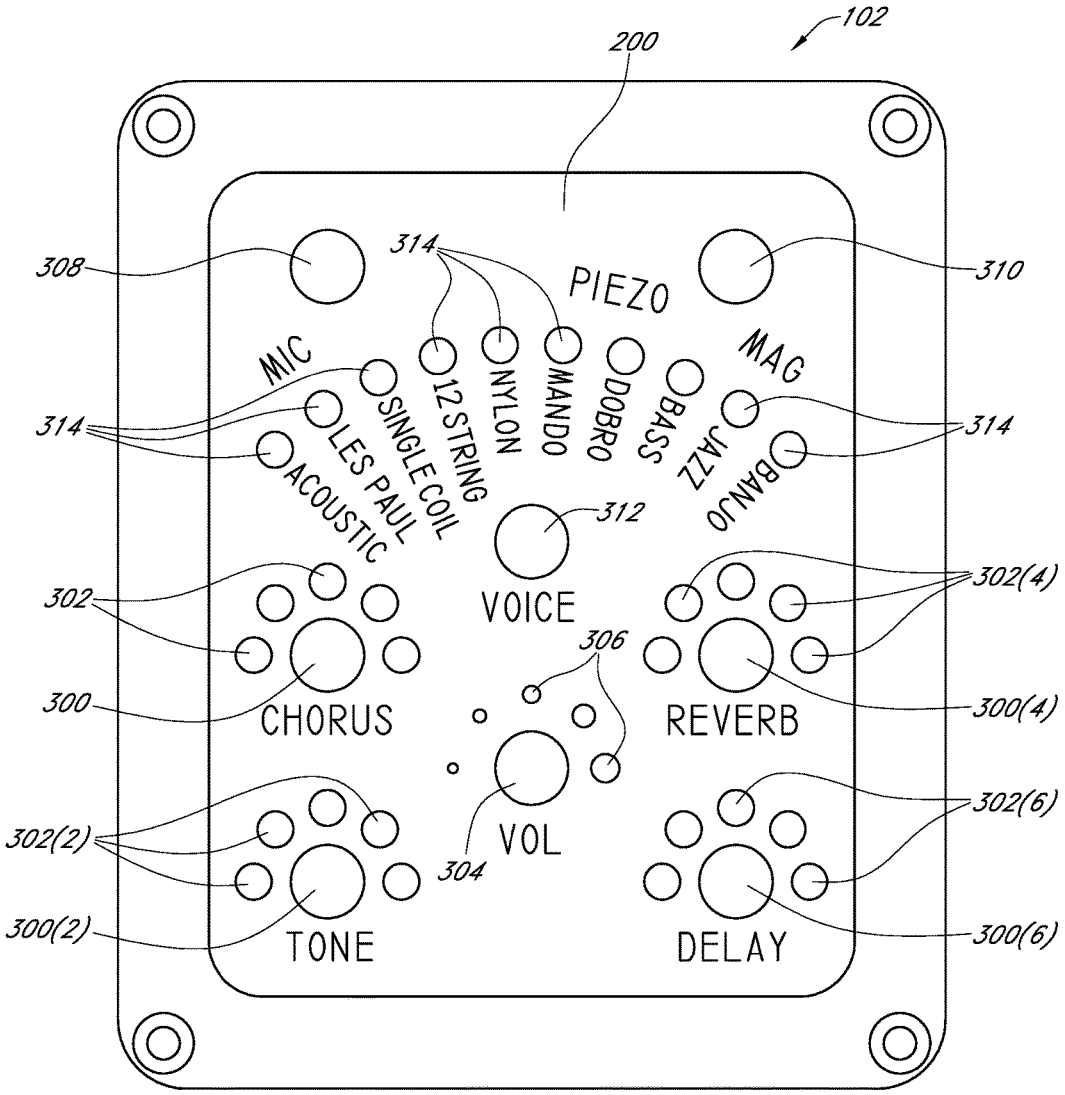
FIG. 3 illustrates an example face of user interface module in accordance with various implementations of acoustic guitar user interface.

FIG. 3 illustrates an example face 200 of user interface module 102 in accordance with various implementations of acoustic guitar user interface. As discussed above, face 200 can include any interaction devices 204 known in the art (including interaction devices and/or functionality on a touchscreen) allowing a user to interact with functionality in user interface module 102. These can include, for example, effect controllers 300 configured to allow a user to interact with various audio effects, such as a chorus effect, a tone effect, a reverb effect, a delay effect, etc. In one possible embodiment, effect controllers 300 can include any type of dials known in the art, including, for example, illuminated rotary encoders, such as RGB LED encoders, having one or more associated LEDs 302 (including, for example, LED 302(2), LED 302(4), LED 302(6), etc.) configured to visually indicate a level to which the corresponding dial has been set.

Interaction devices 204 can also include an interaction device, such as a volume controller 304, enabling a user to control the gain of an audio signal output from acoustic guitar 100 via user interface module 102. In one possible embodiment, volume controller 304 can include any type of dial known in the art, including, for example, an illuminated rotary encoder, such as a RGB LED encoder, having one or more associated LEDs 306 visually indicating a level to which volume controller 304 has been set.

Interaction devices 204 can also include any interaction devices known in the art enabling a user to determine a blend of various sensing sources used to sense sounds being made by acoustic guitar 100 including for example, sliders, potentiometers (including two blend potentiometers), etc., and any possible combination thereof. In one possible implementation, these interaction devices can include one or more input blend controllers, such as, for example, a microphone blend controller 308 and a piezo-mag blend controller 310. The sensing sources can include anything known in the art, including a microphone (such as, for example, an electret-condenser microphone), a piezo pickup, a magnetic pickup with any size audio jack known in the art, and any possible combination thereof.

In one possible embodiment, when a piezo pickup and a magnetic pickup are available to detect and convert sounds from acoustic guitar 100 into one or more electronic signals, the user can utilize piezo-mag blend controller 310 to influence the blend of signals accepted at user interface module 102 from the piezo pickup and the magnetic pickup. For instance, a user can get one hundred percent of the signal detected at the piezo pickup and zero percent of the signal detected at the magnetic pickup by positioning piezo-mag blend controller 310 at a first side. Alternately, the user can get zero percent of the signal detected at the piezo pickup and one hundred percent of the signal detected at the magnetic pickup by moving piezo-mag blend controller 310 to an opposite second side. The user can also select any blend there between by positioning piezo-mag blend controller 310 at various points between the first side and the second side. For example, if the user desires the detected signal to have a 50/50 blend (i.e. fifty percent of the detected signal from the magnetic pickup and fifty percent of the detected signal from the piezo pickup) the user can position piezo-mag blend controller 310 in a middle position equidistant from the first side and the second side. In one possible aspect, piezo-mag blend controller 310 can include any type of dial known in the art, including, for example, a potentiometer.

In instances when a microphone is also present, microphone blend controller 308 can be used to modify the influence of signal(s) created by the microphone in the overall blend of signals being provided to user interface module 102 from the various sensing sources used to sense sounds at guitar 100. Microphone blend controller 308 can include any interaction device known in the art, including for example, a slider, a potentiometer, a dial (such as, for example, a potentiometer), etc.

In one possible aspect, if microphone blend controller 308 is positioned all the way to a first side, signal(s) from the microphone will not be included in the various signals from the available sensing sources utilized by user interface module 102. Stated another way for the sake of clarity, the signals utilized by user interface module 102 in such a scenario will be made up of sounds detected using sensing sources other than the microphone.

Alternately, if the user wishes to have nothing but the sounds detected by the microphone included in the signal(s) used by user interface module 102, the user can position microphone blend controller 308 at an opposite second side. Similarly, if the user desires to have a 25/75 blend (i.e. twenty five percent of the sounds being detected from acoustic guitar 100 coming from the microphone and seventy five percent coming from the other detection sources—such as the piezo pickup and the magnetic pickup) the user can position microphone blend controller 308 twenty five percent of the way from the first side to the second side. In such a manner, by using microphone blend controller 308 and piezo-mag blend controller 310 the user can customize the blend of signals from sensing sources being used by user interface module 102 to any blend desirable.

In one possible embodiment, the user can also choose from among a variety of preset audio effect selections (also known as voices and/or patches) using a voice controller 312. Voice controller 312 can include any interaction device known in the art including a slider, a potentiometer, a variety of buttons (i.e. with each button corresponding to a different voice), etc. For example, in one possible implementation, voice controller 312 can include a dial, such as, for example, a rotary encoder with LED illumination, such that a user can turn voice controller 312 and select a desired patch 314 by cycling through LEDs associated with the available patches 314. For example, if the user wants a single coil patch 314, the user can manipulate voice controller 312 until an LED corresponding to single coil patch 314 is illuminated.

Any number and/or variety of preset patches 314 can be used in conjunction with user interface module 102 to modify the sounds detected from guitar 100 in any manner known in the art. For example, patches 314 can exist with audio effects that modify the sounds detected from guitar 100 to sound as though they have come from another instrument (such as, for example, a mandolin, a banjo, a bass guitar, an electric guitar, etc.). Patches 314 can also exist with audio effects that modify the sounds detected from guitar 100 to sound as though different types of strings are being used on acoustic guitar 100 than are actually in use. For example, a "nylon" patch 314 can make steel strings sound like nylon strings. In other possible aspects, patches 314 can modify the sounds detected from acoustic guitar 100 to sound as though they were detected from a variety of detecting functionality, such as, for example, from single coil pickups, etc.

Patches 314 may be preset, such as by a manufacturer or marketer of acoustic guitar 100 and/or user interface module 102, and/or patches 314 may be set by a user (i.e. open patches 314). For example, if a user wants a patch 314 that is a particular blend of chorus and reverb effects, the user can set effect controller 300 and effect controller 300(4) to the appropriate levels, and turn off effect controller 300(2) and effect controller 300(6). This preset effect template can then be saved and associated with a user determined patch 314 on face 200 so that if the user desires this patch 314 in the future, he can select the user determined patch 314 using the voice controller 312. When the user determined patch 314 is chosen in the future, the blend of chorus and reverb previously set will be used to manipulate the sound of acoustic guitar 100 output by user interface module 102.

The effect templates associated with patches 314 (including those preset by the manufacturer, and those created by a user) can be set in a variety of ways to approximate any sound desired by a user. For example, in one possible implementation, patches 314 can be created by setting a mix of audio effects associated with effect controllers 300 to arrive at a desired effect template. In another possible implementation, one or more patches 314 can be created by using separate audio effects associated with dedicated functionality in user interface module 102 distinct from the effects associated with effect controllers 300. For example, in one possible aspect, a "12 string" patch 314 may be configured to approximate the sound of a twelve-string guitar from a signal received from a six string acoustic guitar 100 by relying on separate dedicated functionality (such as a series of comb filters, etc.) in audio effect module 202.

In yet another possible implementation, patches 314 can be created using a mix of audio effects including separate dedicated functionality in audio effect module 202 along with effects associated with effect controllers 300. For example, a "12 string reverb" patch 314 can use separate dedicated functionality in audio effect module 202 along with a reverb effect associated with effect controller 300(4).

A user can interact with user interface module 102 in a variety of possible ways. For example, in one possible embodiment, user interface module 102 can be turned on and off through use of a dedicated on/off user interaction device, such as a button, switch, etc. Alternately, or additionally, user interface module 102 can be turned on and off by interacting with other user interface functionality 204 available on face 200. For instance, when one of controllers 300, 304, 308, 310 includes a momentary push button, the user can turn user interface module 102 on and off by pushing the controller for a preset period of time (such as, for example, one or more seconds). Such a controller can have any switch travel known in the art, including, for example, 0.5 mm.

In another possible implementation, a status of batteries (such as battery power remaining, etc.) associated with user interface module 102 can be viewed in a variety of possible ways. For example, a dedicated battery status indicator can exist on face 200. Alternately, or additionally, when one of controllers 300, 304, 308, 310 includes a momentary push button, pushing the controller for a preset period of time (such as, for example, less than one second) can activate a display showing the status of the batteries. The display can be accomplished in any manner known in the art, including the use of an icon on a screen and/or use of one or more LEDs on face 200.

For example, a high battery status can be indicated by illuminating all of the LEDs associated with patches 314 on face 200, such as, for example, by turning all or some of the LEDs associated with patches 314 on face 200 to a preset color, etc. "High" battery status can be any range of remaining batter life preset into user interface module 102. For instance, "High" battery status can be preset to mean the batteries are at 100% strength, 90+% strength, 80+% strength, etc.

A low battery status can be indicated by illuminating some of the LEDs associated with patches 314 on face 200, such as, for example, by turning all or some of the LEDs associated with patches 314 on face 200 to a preset color, etc. "Low" battery status can be preset to mean the batteries are at less than 40% strength, less than 30% strength, less than 20% strength, less than 10% strength, less than 10% strength, etc.

In one possible implementation, a status of batteries between high and low can be indicated by illuminating a number of LEDs associated with patches 314 proportional to the battery power available. For example, if fifty percent battery power is available, fifty percent of the LEDs associated with patches 314 can be illuminated.

In yet another possible implementation, when available battery power gets below a preset level (such as ten percent or any other preset threshold), a user can be automatically alerted through any of a variety of displays. For example, a warning may be shown on a screen, the LEDs associated with patches 314 can be manipulated (i.e. flash, fade, turn different colors, etc.) and so on.

It will be understood that in the status of battery examples above, even though use of LEDs associated with patches 314 were mentioned, LEDs associated with one or more of controllers 300, 304 may also be used (such as in addition to LEDs associated with patches 314, and/or in place of them).

In one possible implementation, when one of controllers 300, 304, 308, 310 includes a momentary push button, pushing the controller several times, such as, for example, two times with a preset interval of time in between (such as, for instance, two seconds) can allow a user to enter into an advanced menu/advanced settings mode where the user can manipulate user interface module 102, including making changes to existing patches 314, programming new patches 314, viewing a firmware version of the user interface module 102 (if present), calibrating one or more of the pickups present on acoustic guitar 100, changing an auto timeout preset for user interface module 102, etc. For example, in one possible aspect, a double push on volume controller 304 can allow a user to enter an advanced settings mode in which the voice controller 312 can be used to select one or more advanced functions with each LED associated with voice controller 312 indicating an advanced function. In one possible aspect, a short press of voice controller 312 can select the advanced function. For example, advanced functions can include version display with effect LED rings illustrating four digits of the version number.

In one possible aspect, when a patch 314 is changed by a user (either through manipulation in the advanced menu or otherwise) the original manufacturer's settings (i.e. the factory settings) for the patch 314 can be restored and/or recalled when user interface module 102 is turned off then on again. Alternately, or additionally, the original manufacturer's settings for the patch 314 can be restored by pushing a controller, such as voice controller 312, for more than a preset time (such as, for example, one second).

In one possible embodiment, when a rotary controller with an LED indicator is used as an interaction device 204 (such as, for example, as one or more of effect controllers 300, volume controller 304, voice controller 312, microphone blend controller 308 and piezo-mag blend controller 310), the rotary controller can rotate from zero percent to one hundred percent in, for example, five percent rotary clicks. Alternately the rotary controller can offer a user a smaller number of selections, such as five different clicks. In one possible aspect, the default effect parameter can be wet level after user interface module 102 is powered up and/or after a new patch 314 is selected.

In one possible aspect, any number of LEDs can be used in conjunction with the rotary controller to indicate what level the controller is set at. For example, if five LEDs are employed, all LEDs can be off when the rotary controller is turned off, one LED can be on when the rotary controller is set at or below twenty percent, two LEDs can be on when the rotary controller is set from between twenty to forty percent, and so on until all five LEDS are on when the controller is set between eighty and one hundred percent. Alternately, or additionally, to enable more granularity in displaying the rotary controller's level, the LEDs can have various brightnesses. For example, if an LED has four levels of brightness, if one LED is on, and the LED is at the first level of brightness, the rotary controller can be seen to be set at ranges from zero to five percent. If the solitary lit LED is at the second level of brightness, the rotary controller can be seen to be set at ranges from five to ten percent. Similarly, if the solitary lit LED is at the third level of brightness, the rotary controller can be seen to be set at ranges from ten to fifteen percent, and if the solitary lit LED is at the fourth level of brightness, the rotary controller can be seen to be set at ranges from fifteen to twenty percent.

In one possible aspect, an effect controller 300 with RGB LED illumination, a momentary push button, and a rotary control can be employed to enable a user to manipulate an effect, including for example, when a user is manipulating effects in a patch 314. In such an instance, the number of LEDs present can be used to indicate the strength of a parameter value set by controller 300 (such as from zero to one hundred percent as described above, for example) and the RGB aspect can be used to indicate the parameter itself being set. For instance, when controller 300 is associated with a chorus effect, the color of controller 300 (i.e. green, yellow, red, blue, etc.) can indicate what parameter of the chorus effect (i.e. chorus wet level, chorus type, chorus rate, chorus depth, etc.) is currently active and available to be manipulated by a user. In one possible aspect, the user can cycle through the various parameters by pressing the push button for a preset time (such as, for example, less than one second). In another possible aspect, the user can reset the original settings associated with the effect (such as in a patch 314 being manipulated by the user) by pressing the push button for a preset time (such as, for example, more than one second).

In one possible aspect, a reverb effect can have various parameters including a reverb wet level, a reverb type, reverb size, reverb damping, etc. Similarly, a delay effect can have various parameters including a delay wet level, a delay type, a delay size, a delay time, etc.

In one possible aspect, a voice controller 312 with RGB LED illumination, a momentary push button, and a rotary control can be employed to enable a user to access and manipulate patches 314. For example, patches 314 can be cycled through by turning the rotary control, and a push of the momentary push button for a preset time (such as, for example, less than one second) can reset the patch 314 to its default values.

In one possible implementation, a user can interact with user interface module 102 in any of the ways described herein via an external device such as, for example, a smartphone, a tablet, a laptop, a computer (including a computer connected to a cloud), etc. Such interactions can include, for instance, entering the advanced menu/advanced settings mode, manipulating patches 314 and other functionality in user interface module 102, creating new patches 314, downloading information (including new patches, tracks, effects, etc.) to user interface module 102 from the external device, etc. In one possible embodiment, the user can be provided with a graphical interface on the external device such as through an app, etc., running on the external device.

For example, in one possible implementation, one or more audio tracks, such as a drum lick, a bass track, a guitar track, a backing vocals track, a lead vocals track, etc., can be downloaded to user interface module 102 from an external device. In one possible aspect, one or more of these downloaded tracks can be mixed with sounds created at acoustic guitar 100 (including sounds created at acoustic guitar 100 and modified by user interface module 102) and be sent to an output jack of user interface 102. In one possible embodiment, downloaded tracks such as these can allow a user interacting with acoustic guitar 100 to perform as a one-man band.

In another possible implementation, signals from user interface module 102, including in some instances one or more downloaded audio tracks, can be transmitted to an external device for recording, further manipulation (such as mixing, etc.), further transmission to other devices such as a public address system, etc. User interface module 102 and the external device can communicate with each other using any wired and/or wireless technologies known in the art.

In one possible implementation, user interface module 102 can include battery saving functionality. For example, when a user has not interacted with acoustic guitar 100 for a preset amount of time (such as, for example, 5 minutes, 10 minutes, 15 minutes, 20 minutes, etc.) user interface module 102 can automatically direct itself and, if desired, other electronic functionality on acoustic guitar 100, to shut down (i.e. go into power off mode). In one possible aspect, the amount of time of user inactivity before shutdown can be preset by a manufacturer of user interface module 102, a marketer of user interface module 102, and/or be set by the user.

In another possible implementation, when a user has not interacted with acoustic guitar 100 for a preset amount of time, user interface module 102 can automatically dim and/or turn off some or all LEDs on face 200 (i.e. go into standby mode). In one possible aspect, the amount of time of user inactivity before dimming or shutdown of the LEDs can be set by the user, the manufacturer and/or the marketer of user interface module 102.

In one possible aspect, before going into standby mode and/or power off mode, settings on user interface module 102 (such as settings of audio effects, etc.) can saved and automatically recalled when user interface module 102 is powered up again. Moreover, in another possible aspect, after user interface module 102 has gone into standby mode and/or power off mode, user interface module 102 can automatically turn the LEDs on again when the user interacts with guitar 100 again (i.e. such as when, for example, sound is created at acoustic guitar 100).

In yet another possible implementation, one or more interaction devices 204 on user interface module 102 can be used to adjust a gain on each individual string on acoustic guitar 100.

In still another possible implementation, user interface module 102 can include a headphone out, such as at a preamplifier in user interface module 102, allowing a user of acoustic guitar 100 to sample sounds coming from user interface module 102.

In one possible embodiment, user interface module 102 can include an audio combo jack (such as, for example, an XLR 6.35 mm audio combo jack) with an audio connection and an adaptor printed circuit board (PCB). User interface module 102 can also include a harness for connecting the audio combo jack with an encoder PCB. Moreover, in one possible aspect, audio output from user interface module 102 can be active and low impedance and interfaced via the combo audio jack to provide asymmetrical stereo output on the jack connection and symmetrical mono output on the XLR connection.

Asymmetrical stereo output can be provided at any output voltage known in the art, including, for example, voltages below, up to, and over 5 Vpp. Symmetrical mono audio output can be provided at any output voltage known in the art, including, for example, voltages below, up to, and over 10 Vpp. In one possible aspect, at 5 Vpp, a signal to noise ratio (SNR) can be 90 dB or higher.

Example Block Diagrams

Figure 4:
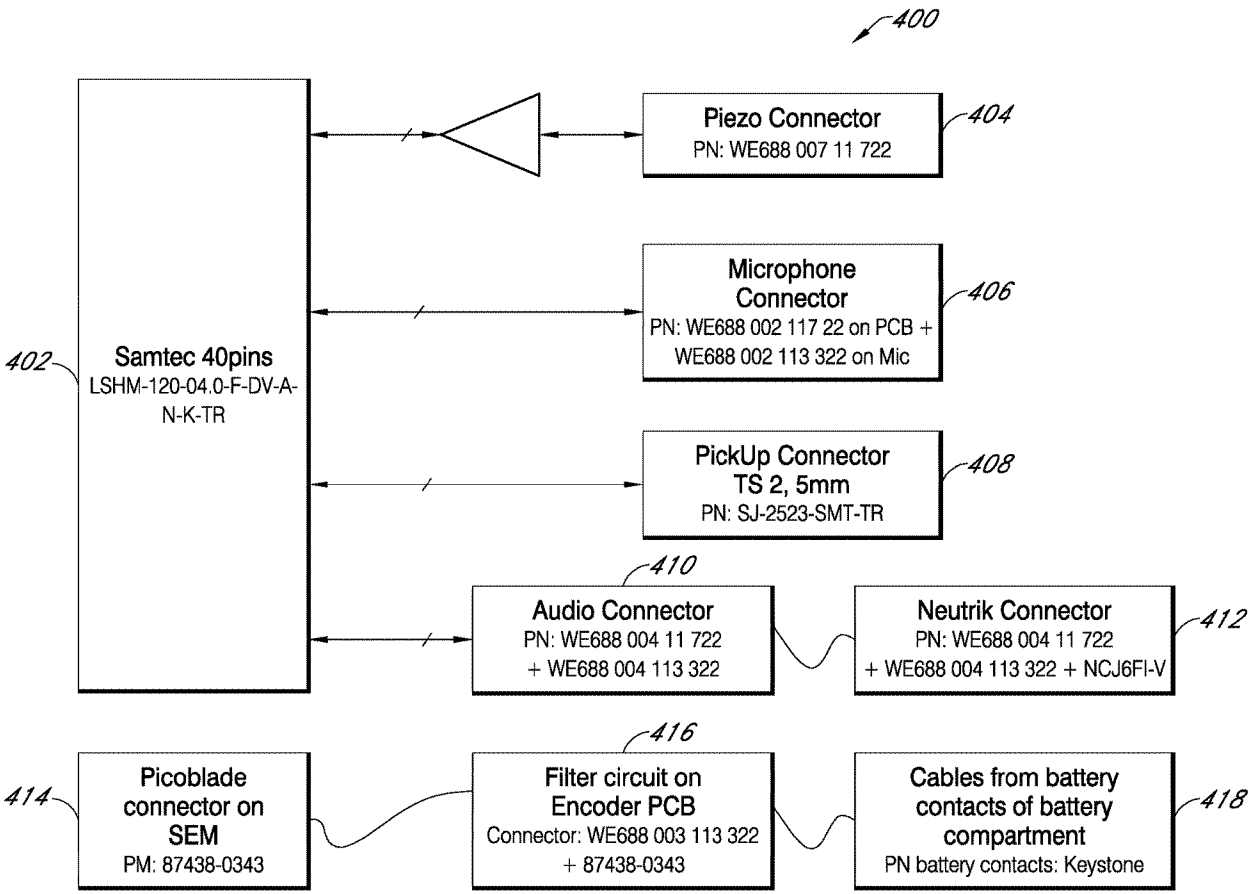
FIG. 4 illustrates an example electronic block diagram in accordance with various embodiments of acoustic guitar user interface.
Figure 5:
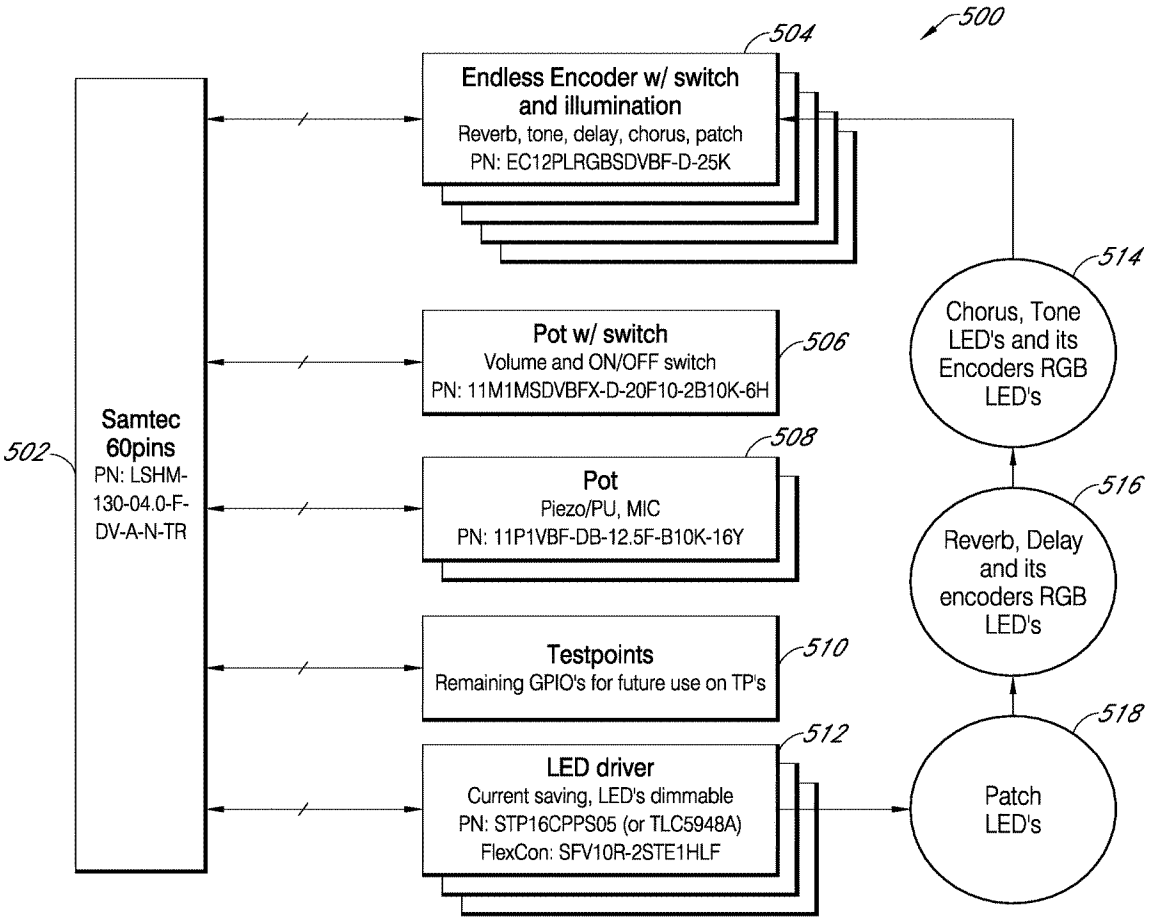
FIG. 5 illustrates another example electronic block diagram in accordance with various embodiments of acoustic guitar user interface.
Figure 6:
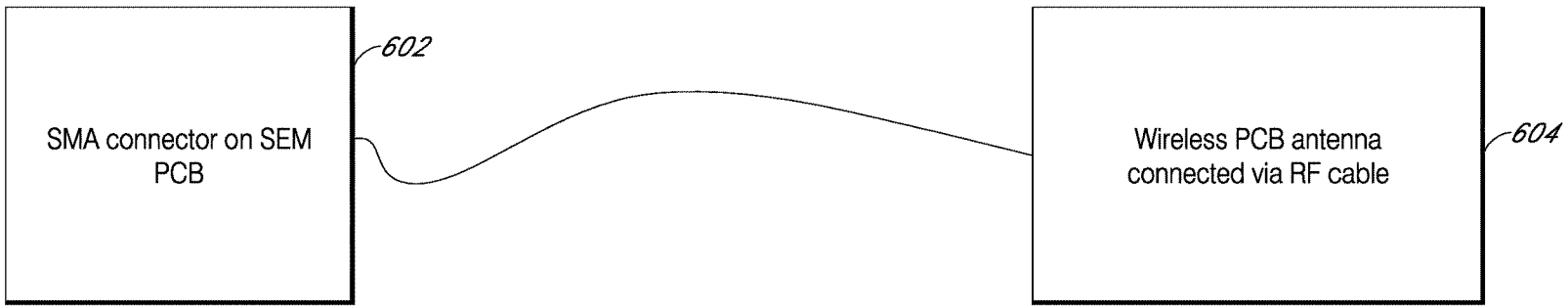
FIG. 6 illustrates example communication functionality in accordance with various embodiments of acoustic guitar user interface.

FIGS. 4-6 include example block diagrams of various components that can be used to implement aspects of acoustic guitar user interface. In some instances, components are labeled with particular part numbers, manufacturers, etc. It will be understood, however, that such labeling is for illustrative purposes only, and that each such labeled component can be substituted with any other equivalent and/or similarly functioning component(s) known in the art (including components from other manufacturers and/or having other part numbers, etc.). For example, if a first connector from manufacturer A having a certain number of pins is recited, it will be understood that one or more other connectors known in the art from any other manufacturer with the same or different number of pins can be substituted in its place as long as the substitute connector(s) can be configured to have the same and/or similar functionality as the first connector.

FIG. 4 illustrates an electronic block diagram 400 of an example connector 402 that can be used with various embodiments of acoustic guitar user interface. All or parts of the various components shown in block diagram 400 can exist in user interface module 102 and/or outside of user interface module 102, such as on guitar 100, for example. Moreover, in one possible implementation, one or more of the connections illustrated in block diagram 400 can include analog connections.

Connector 402 can be used in conjunction with various other connectors, including, for example, a piezo connector 404 associated with any type of piezo pickup known in the art, a microphone connector 406 associated with any type of microphone known in the art, and a pick up connector 408 associated with any type of pickup known in the art (including, for instance, a magnetic pickup). An audio connector 410 associated with various audio sources can also be connected to connector 402. In one possible implementation, audio connector 410 can be associated with a connector 412 marketed by The Neutrik Group headquartered in Schaan, Liechtenstein.

Any number of connections can exist between the various connectors 404, 406, 408, 410 and connector 402. For example, in one possible implementation, seven connections can exist between piezo connector 404 and connector 402, two connections can exist between microphone connector 406 and connector 402 (such as, for example, a sound connection and a ground connection), two connections can exist between pickup connector 408 and connector 402, and four connections can exist between audio connector 410 and connector 402.

In one possible embodiment, a PICOBLADE connector 414 marketed by the Molex Connector Corporation of Lisle, Ill. may also be utilized in connection with a filter circuit 416 on an encoder printed circuit board (PCB) and one or more cables 418 from contacts associated with the battery compartment on guitar 100.

FIG. 5 illustrates an example electronic block diagram 500 of an example connector 502 that can be used with various embodiments of acoustic guitar user interface. All or parts of the various components shown in block diagram 500 can exist in user interface module 102 and/or outside of user interface module 102, such as on guitar 100, for example. Moreover, in one possible implementation, one or more of the connections illustrated in block diagram 500 can include digital connections.

Connector 502 can be used in conjunction with various functionality, including, for example, one or more encoders 504 (including any encoders known in the art). In one possible aspect, encoders 504 can include one or more effect controllers 300. Connector 502 can also be used in conjunction with one or more potentiometers 506 with a switch, such as some implementations of volume controller 304 with a switch (such as, for example, a momentary push button) configured to turn user interface module 102 on and off. Connector 502 can also be used in conjunction with one or more other potentiometers 508, such as, for example, piezo-mag blend controller 310, microphone blend controller 308, etc.

In one possible aspect connector 502 can be connected to one or more testpoints 510 and one or more LED drivers 512 associated with various LEDs on face 200, including, for example, LEDs 514, 516 associated with effect controllers 300 and LEDs 518 associated with patches 314.

Any number of connections can exist between the functionality and connector 502. For example, in one possible implementation, fifteen connections can exist between encoder 504 and connector 502, two connections can exist between potentiometers 506 and connector 502, two connections can exist between potentiometers 508 and connector 502, and six connections can exist between LED drivers 512 and connector 502. In one possible aspect one or more of these 6 connections can include flex cables.

FIG. 6 illustrates example communication functionality that can be used with various embodiments of acoustic guitar user interface. As illustrated, a printed circuit board (PCB) 602 such as any PCB known in the art that might be associated with user interface module 102 can be coupled to a wireless PCB antenna 604. Wireless PCB antenna 604 can include any antenna known in the art configured to communicate in any wireless protocol known in the art. In one possible aspect, wireless PCB antenna 604 can be configured to allow communication between user interface module 102 and a variety of external devices, as discussed in various embodiments described herein, and can exist as an antenna module in user interface module 102.

Example Multiple String Filter

Figure 7:
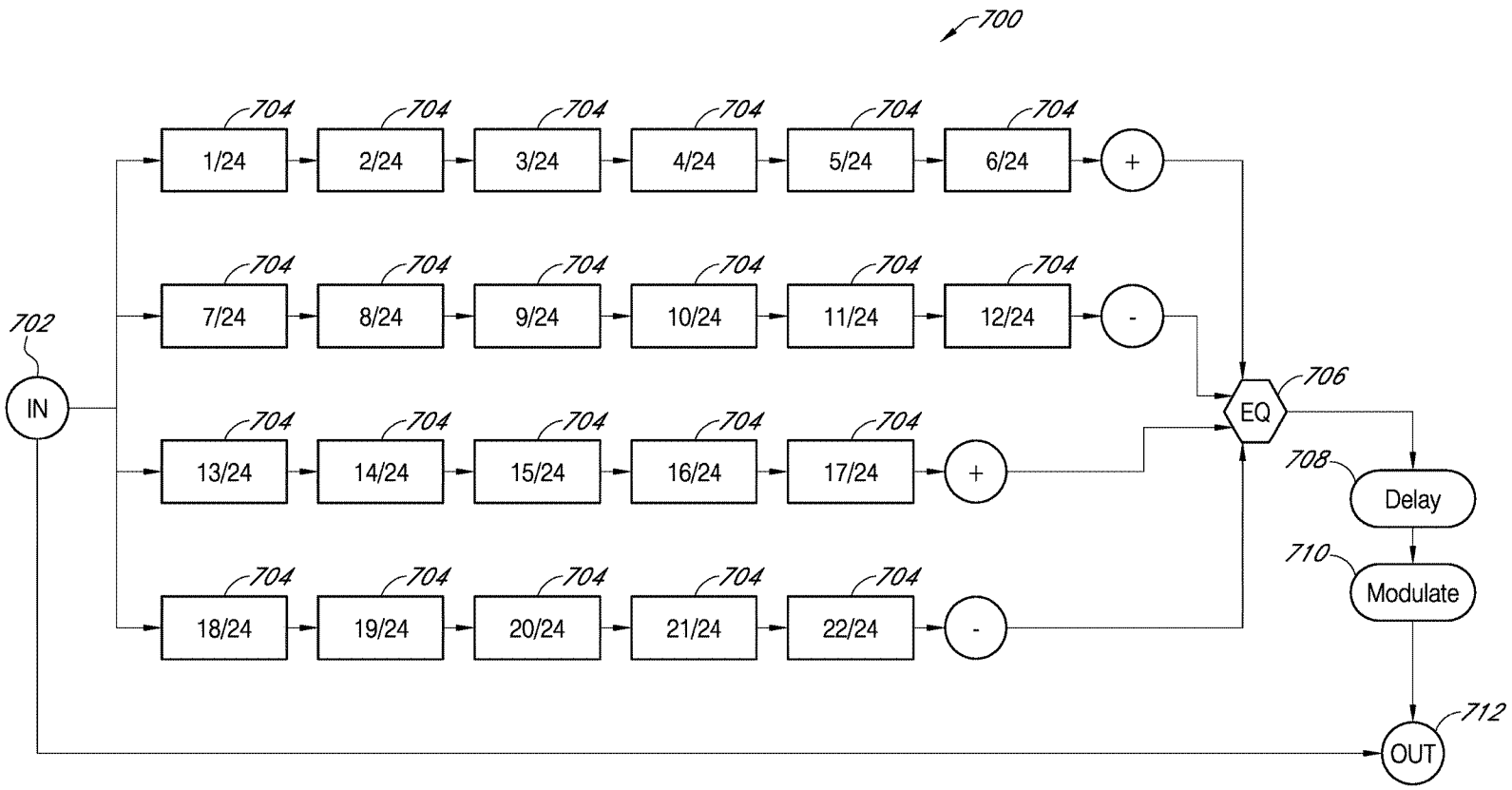
FIG. 7 illustrates example filter functionality in accordance with various embodiments of acoustic guitar user interface.

FIG. 7 illustrates an example multiple string filter 700 in accordance with various embodiments of acoustic guitar user interface. In one possible implementation, a first path of an audio signal, such as an audio signal from acoustic guitar 100 (such as, for example, when acoustic guitar 100 has six input strings) can be fed from an input 702 through a series of comb filters 704 tuned to one or more desired musical scale frequencies and with periods one octave above the approximate fundamental frequencies of the input strings. The output of the comb filters 704 can be received and mixed at an equalizer 706 before being sent through a delay 708 and a modulation processor 710 to arrive at an output 712.

In one possible aspect, the unprocessed signal from input 702 can be fed directly to each comb filter 704 and the output of each comb filter 704 can be fed directly to equalizer 706 without being processed in series by another comb filter 704.

In parallel, a second path of the audio signal can be fed straight from input 702 to output 712 such that a dry version of the audio signal and a filtered/processed version of the audio signal can be mixed at output 712.

Any amount of comb filters 704 may be used in multiple string filter 700. For instance, in one possible embodiment, twenty three comb filters 704 can be used. In one possible implementation, each comb filter 704 can cycle three iterations of its period, with the periods corresponding to half semi-tones. In one possible aspect, the periods can be calculated starting with 164.82 Hz and multiplying by 2^(1/24) for each subsequent frequency. In one possible embodiment, a multi-tap technique can be utilized so that all comb filters 704 and their repeats are implemented with various offsets into the same FIFO.

In one possible aspect, one or more of comb filters 704 can include one or more redundant harmonics. In order to avoid emphasizing such harmonics, the output of some of comb filters 704 can be phase inverted.

In one possible embodiment, the signal output from comb filters 704 can be processed by IIR filters to apply an impulse response to emulate an instrument and/or to reduce some of the shrill frequencies produced by comb filters 704. In one possible aspect, magnetic pickup 9 band parametric EQ can be used when a 12 string mode patch 314 has been chosen on face 300, and no magnetic pickup is available.

After processing at equalizer 706, output signal can be processed like a chorus effect with delay and modulation, such as at delay 708 and modulation processor 710. The output signal can then be mixed with the unprocessed/dry signal from input 702 (though in some implementations, the unprocessed/dry signal may have passed through other effects in user interface module 102).

Multiple string filter 700 can be constructed using analog components, digital components (including software, firmware, etc.) and any combination thereof. Further all or part of multiple string filter may reside in user interface module 102, and can be utilized to process a signal from acoustic guitar 100 when a user has selected a patch 314 with which the multiple string filter is associated, such as a multiple string effect patch 314 (including, for example, a "12 string" filter patch 314).

Example Methods

Figure 8:
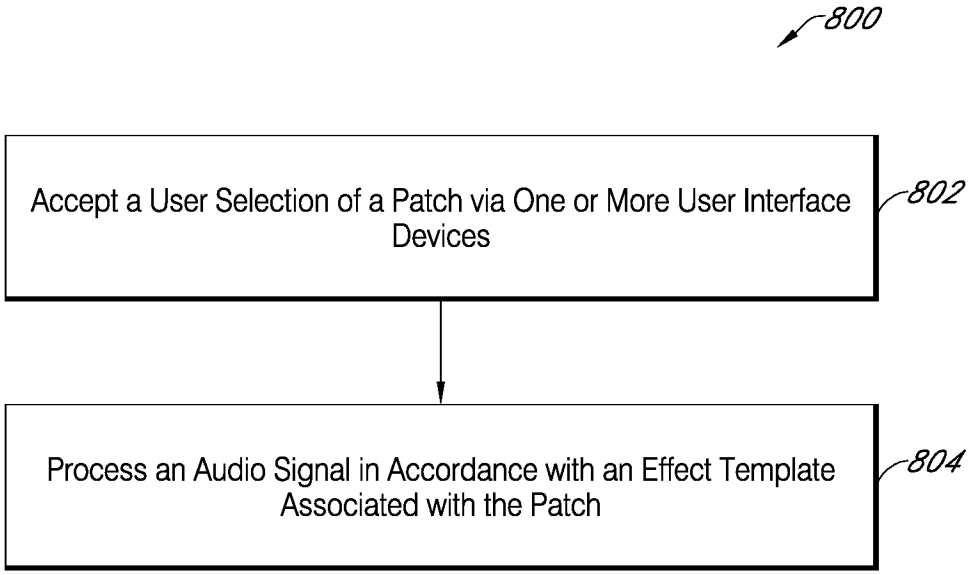
FIG. 8 illustrates example methods(s) that can be used in accordance with various embodiments of acoustic guitar user interface.

FIG. 8 illustrates an example method for implementing aspects of acoustic guitar user interface. The method is illustrated as a collection of blocks and other elements in a logical flow graph representing a sequence of operations that can be implemented in hardware, software, firmware, various logic or any combination thereof. The order in which the method is described is not intended to be construed as a limitation, and any number of the described method blocks can be combined in any order to implement the method, or alternate methods. Additionally, individual blocks and/or elements may be deleted from the method without departing from the spirit and scope of the subject matter described therein. In the context of software, the blocks and other elements can represent computer instructions that, when executed by one or more processors, perform the recited operations. Moreover, for discussion purposes, and not purposes of limitation, selected aspects of the method may be described with reference to elements shown in FIGS. 1-7 and FIG. 9.

FIG. 8 illustrates an example method 800 associated with embodiments of acoustic guitar user interface. At block 802 a user enters a selection of a patch, such as a patch 314, via one or more user interface devices, such as user interface devices 204, on a user interface module, such as user interface module 102 and/or user interface devices on an external device such as a smartphone, a mixer, a tablet, a laptop, etc. In one possible implementation, the user can enter the patch selection using a voice controller, such as voice controller 312.

At block 804, the patch selected by the user in block 802 is used to process an audio signal, such as an audio signal associated with a guitar, such as, for example, acoustic guitar 100. This includes processing the audio signal using an effect template associated with the selected patch. In one possible implementation, the effect template can be achieved using one or more audio effects in a user interface module, such as user interface module 102.

Example Computing Device(s)

Figure 9:
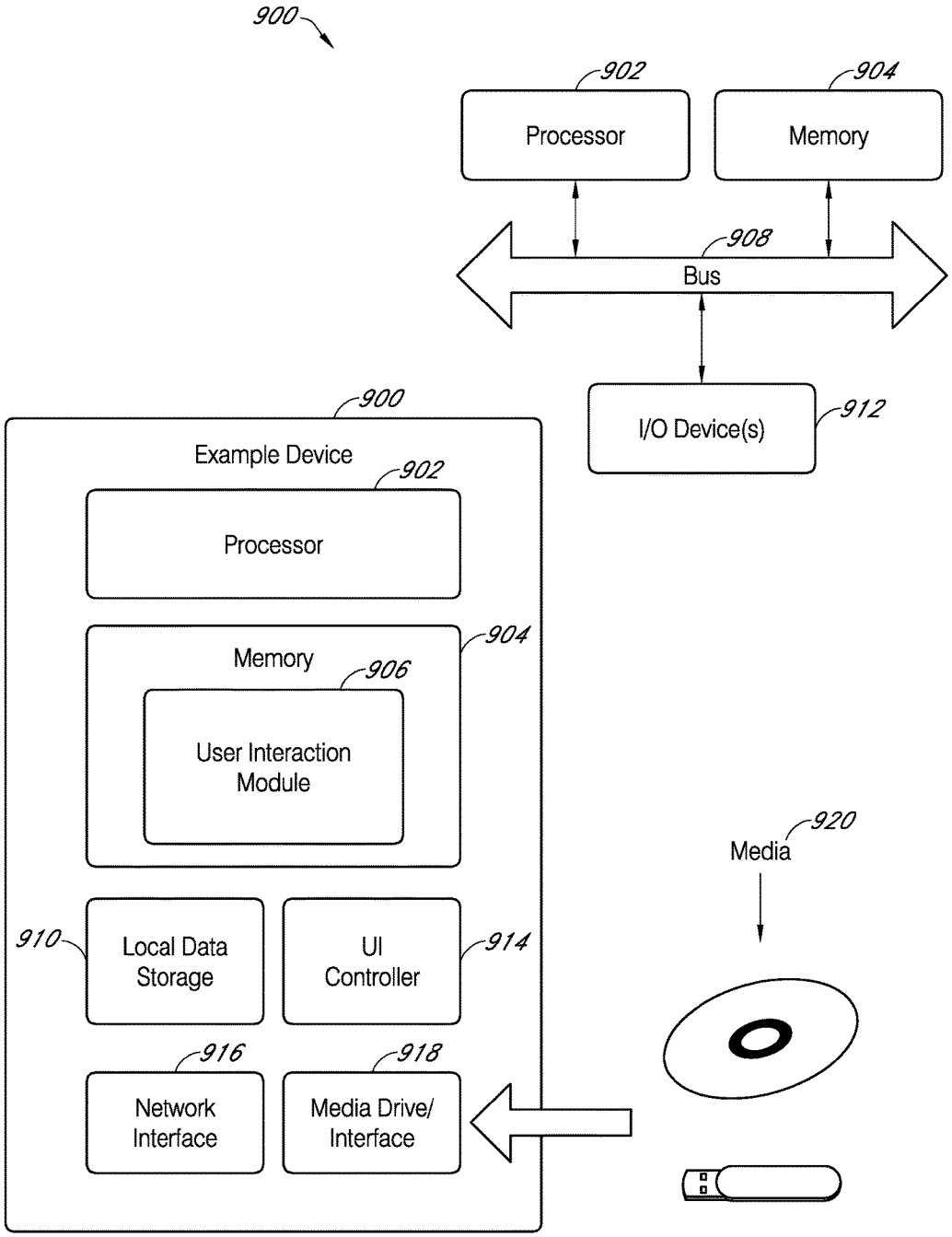
FIG. 9 illustrates an example computing device that can be used in accordance with various embodiments of acoustic guitar user interface.

FIG. 9 illustrates an example device 900, with a processor 902 and memory 904 for hosting a user interaction module 906 configured to implement various embodiments of acoustic guitar user interface as discussed in this disclosure. In one possible implementation, all or portions of user interface module 102 may be implemented using all or portions of example device 900 and/or various other functionality. For example, all or portions of user interface module 102, including all or parts of user interaction devices 204 and all or parts of audio effect module 202 (including, for example, various audio effects) may be implemented using example device 900 (such as, for example, as various sub modules within user interaction module 906). Alternately, or additionally, some or all of user interface module 102, user interaction devices 204 and audio effect module 202 may be implemented through use of other functionality, such as electronic circuitry, etc.

Memory 904 can also host one or more databases and can include one or more forms of volatile data storage media such as random access memory (RAM), and/or one or more forms of nonvolatile storage media (such as read-only memory (ROM), flash memory, and so forth). In one possible implementation, memory 904 can store a variety of data discussed herein, including, for example, identification information, effect templates for patches 314, various presets, etc.

Device 900 is one example of a computing device or programmable device, and is not intended to suggest any limitation as to scope of use or functionality of device 900 and/or its possible architectures. For example, device 900 can comprise one or more computing devices, programmable logic controllers (PLCs), etc.

Further, device 900 should not be interpreted as having any dependency relating to one or a combination of components illustrated in device 900. For example, device 900 may include one or more of a computer, such as a laptop computer, a desktop computer, a mainframe computer, a smart phone, an audio mixer, an effects rack, a musical instrument, a simple on chip computing device, etc., or any combination or accumulation thereof.

Device 900 can also include a bus 908 configured to allow various components and devices, such as processors 902, memory 904, and local data storage 910, among other components, to communicate with each other.

Bus 908 can include one or more of any of several types of bus structures, including a memory bus or memory controller, a peripheral bus, an accelerated graphics port, and a processor or local bus using any of a variety of bus architectures. Bus 908 can also include wired and/or wireless buses.

Local data storage 910 can include fixed media (e.g., RAM, ROM, a fixed hard drive, etc.) as well as removable media (e.g., a flash memory drive, a removable hard drive, optical disks, magnetic disks, and so forth).

One or more input/output (I/O) device(s) 912 may also communicate via a user interface (UI) controller 914, which may connect with I/O device(s) 912 either directly or through bus 908.

In one possible implementation, a network interface 916 may communicate outside of device 900 via a connected network, and in some implementations may communicate with hardware, etc.

In one possible embodiment, various equipment may communicate with device 900 as input/output device(s) 912 via bus 908, for example.

A media drive/interface 918 can accept removable tangible media 920, such as flash drives, optical disks, removable hard drives, software products, etc. In one possible implementation, logic, computing instructions, and/or software programs comprising elements of acoustic guitar user interface module 906 may reside on removable media 920 readable by media drive/interface 918.

In one possible embodiment, input/output device(s) 912 can allow a user to enter commands and information to device 900, and also allow information to be presented to the user and/or other components or devices. Examples of input device(s) 912 include, for example, sensors, a keyboard, a cursor control device (e.g., a mouse), a microphone, a scanner, a musical instrument, a pickup, a touchscreen, and any other input devices known in the art. Examples of output devices include a display device (e.g., a monitor, projector, touchscreen, etc.), speakers, a printer, a network card, and so on.

Various processes of acoustic guitar user interface module 906 may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Although a few example embodiments have been described in detail above, those skilled in the art will readily appreciate that many modifications are possible in the example embodiments without materially departing from this disclosure. Accordingly, such modifications are intended to be included within the scope of this disclosure as defined in the following claims. Moreover, embodiments may be performed in the absence of any component not explicitly described herein.

In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" is intended to include "and/or" unless specifically indicated otherwise. The illustrative embodiments may be implemented as a method, apparatus, or article of manufacture using standard engineering techniques.

ILLUSTRATIVE EMBODIMENTS

The following embodiments are illustrative and are not intended to limit the scope of the disclosed subject matter.

Embodiment 1

An acoustic guitar comprising:
a neck;
a body; and
a user interface module comprising:
an audio effect module configured to implement one or more audio effects; and one or more effect controllers, wherein each effect controller is configured to set a level of a corresponding audio effect implemented by the audio effect module;

at least one input blend controller;

a voice controller configured to allow a user to select a patch from a plurality of available patches, wherein each patch of the plurality of available patches comprises a configuration of one or more audio effects set at various levels to arrive at a desired effect template.

Embodiment 2

The acoustic guitar of embodiment 1, wherein the audio effect module is configured to implement one or more of:

a chorus effect;

a tone effect;

a reverb effect;

a delay effect;

a multiple string effect.

Embodiment 3

The acoustic guitar of embodiment 1, wherein the one or more effect controllers comprise one or more light emitting diode rotary encoders.

Embodiment 4

The acoustic guitar of embodiment 1, wherein the at least one input blend controller comprises a two blend potentiometer.

Embodiment 5

The acoustic guitar of embodiment 1, wherein the at least one input blend controller comprises:

a first two blend potentiometer configured to allow the user to adjust a blend between a piezo pickup and a magnetic pickup; and a second two blend potentiometer configured to allow the user to adjust a blend between a microphone and an output set by the first two blend potentiometer.

Embodiment 6

The acoustic guitar of embodiment 1, wherein the voice controller comprises a light emitting diode rotary encoder and a momentary push button.

Embodiment 7

The acoustic guitar of embodiment 6, wherein the voice controller is further configured to enable a user to reset the effect template of a currently selected patch with levels currently selected on the one or more effect controllers by pressing the momentary push button.

Embodiment 8

The acoustic guitar of embodiment 1, further comprising an antenna module configured to allow a user at an external device to interact with the user interface module.

Embodiment 9

The acoustic guitar of embodiment 1, wherein the audio effect module is located in the user interface module.

Embodiment 10

The acoustic guitar of embodiment 1, further comprising battery saving functionality configured to perform one or more of:

automatically turning off the user interface module after a preset period of inactivity between the user and the acoustic guitar;

automatically dimming one or more light emitting diodes on the user interface module after a preset period of inactivity between the user and the acoustic guitar.

Embodiment 11

The acoustic guitar of embodiment 1, wherein the user interface module further comprises a volume controller, wherein the volume controller is further configured to allow the user to access an advanced menu on the user interface module.

Embodiment 12

A user interface module for an acoustic guitar comprising:

a volume controller;

one or more effect controllers, wherein each effect controller is configured to set a level of a corresponding audio effect; and a voice controller configured to allow a user to select a patch from a plurality of available patches, wherein each patch comprises a combination of one or more audio effects set at various levels to arrive at a desired effect template.

Embodiment 13

The user interface module of embodiment 12, wherein the volume controller is configured to allow a user to access an advanced menu on the user interface module.

Embodiment 14

The user interface module of embodiment 12, wherein one or more of the volume controller, the one or more effect controllers, and the voice controller are implemented on one or more touchscreens.

Embodiment 15

The user interface module of embodiment 12, further comprising an antenna configured to communicate with an external device comprising one or more of:

a smart phone;

a tablet;

a laptop computer.

Embodiment 16

The user interface module of embodiment 15, further comprising functionality configured to allow a user to download one or more audio tracks from the external device for manipulation in the user interface module.

Embodiment 17

An acoustic guitar comprising:
a neck;
a hollow body; and
a user interface module comprising:
functionality associated with one or more audio effects;
one or more effect controllers;
at least one input blend controller;
a voice controller configured to allow a user to select from among a plurality of various patches, wherein each patch represents an individual effect template; and
an antenna module configured to facilitate communication between the user interface module and an external device.

Embodiment 18

The acoustic guitar of embodiment 17, wherein the antenna module is configured to allow a user at the external device to interact with the user interface module.

Embodiment 19

The acoustic guitar of embodiment 17, wherein the user interface module further comprises battery saving functionality configured to automatically turn off the user interface module after a preset period of inactivity between the user and the acoustic guitar.

Embodiment 20

The acoustic guitar of embodiment 17, further comprising an array of comb filters configured to create a 12 string guitar effect.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated. It is intended that the scope of the disclosed subject matter be defined by the claims appended hereto and their equivalents.

What is claimed is:

1. An acoustic guitar comprising:
a neck;
a body; and
a user interface module comprising:
an audio effect module configured to implement one or more audio effects;
one or more effect controllers, wherein each effect controller is configured to set a level of a corresponding audio effect implemented by the audio effect module;
at least one input blend controller;
a voice controller configured to allow a user to select a patch from a plurality of available patches, wherein each patch of the plurality of available patches comprises a configuration of one or more audio effects set at various levels to arrive at a desired effect template; and
a volume controller, wherein the volume controller is further configured to allow the user to access an advanced menu on the user interface module.

2. The acoustic guitar of claim 1, wherein the audio effect module is configured to implement one or more of:
a chorus effect;
a tone effect;
a reverb effect;
a delay effect;
a multiple string effect.

3. The acoustic guitar of claim 1, wherein at least one of the one or more effect controllers comprise one or more light emitting diode rotary encoders.

4. The acoustic guitar of claim 1, wherein the at least one input blend controller comprises a two blend potentiometer.

5. The acoustic guitar of claim 1, wherein the at least one input blend controller comprises:
a first two blend potentiometer configured to allow the user to adjust a blend between a piezo pickup and a magnetic pickup; and
a second two blend potentiometer configured to allow the user to adjust a blend between a microphone and an output set by the first two blend potentiometer.

6. The acoustic guitar of claim 1, wherein the voice controller comprises a light emitting diode rotary encoder and a momentary push button.

7. The acoustic guitar of claim 6, wherein the voice controller is further configured to enable a user to reset the effect template of a currently selected patch with levels currently selected on the one or more effect controllers by pressing the momentary push button.

8. The acoustic guitar of claim 1, further comprising an antenna module configured to allow a user at an external device to interact with the user interface module.

9. The acoustic guitar of claim 1, wherein the audio effect module is located in the user interface module.

10. The acoustic guitar of claim 1, further comprising battery saving functionality configured to perform one or more of:
automatically turning off the user interface module after a preset period of inactivity between the user and the acoustic guitar;
automatically dimming one or more light emitting diodes on the user interface module after a preset period of inactivity between the user and the acoustic guitar.

11. A user interface module for an acoustic guitar comprising:
a volume controller;
one or more effect controllers, wherein each effect controller is configured to set a level of a corresponding audio effect;
a first two blend potentiometer configured to allow the user to adjust a blend between a piezo pickup and a magnetic pickup;
a second two blend potentiometer configured to allow the user to adjust a blend between a microphone and an output set by the first two blend potentiometer; and
a voice controller configured to allow a user to select a patch from a plurality of available patches, wherein each patch comprises a combination of one or more audio effects set at various levels to arrive at a desired effect template.

12. The user interface module of claim 11, wherein the volume controller is configured to allow a user to access an advanced menu on the user interface module.

13. The user interface module of claim 11, wherein one or more of the volume controller, the one or more effect controllers and the voice controller are implemented on one or more touchscreens.

14. The user interface module of claim 11, further comprising an antenna configured to communicate with an external device comprising one or more of:

a smart phone;

a tablet;

a laptop computer.

15. The user interface module of claim 14, further comprising functionality configured to allow a user to download one or more audio tracks from the external device for manipulation in the user interface module.

16. An acoustic guitar comprising:

a neck;

a hollow body; and a user interface module comprising:

functionality associated with one or more audio effects;

one or more effect controllers;

a first two blend potentiometer configured to allow the user to adjust a blend between a piezo pickup and a magnetic pickup;

a second two blend potentiometer configured to allow the user to adjust a blend between a microphone and an output set by the first two blend potentiometer;

a voice controller configured to allow a user to select from among a plurality of various patches, wherein each patch represents an individual effect template; and an antenna module configured to facilitate communication between the user interface module and an external device.

17. The acoustic guitar of claim 16, wherein the antenna module is configured to allow a user at the external device to interact with the user interface module.

18. The acoustic guitar of claim 16, wherein the user interface module further comprises battery saving functionality configured to automatically turn off the user interface module after a preset period of inactivity between the user and the acoustic guitar.

19. The acoustic guitar of claim 16, further comprising an array of comb filters configured to create a 12 string guitar effect.

* * * * *